US007639108B2

(12) United States Patent
Miyake

(10) Patent No.: US 7,639,108 B2
(45) Date of Patent: Dec. 29, 2009

(54) ELECTROMAGNETIC SWITCH FOR USE IN STARTER

(75) Inventor: Shinya Miyake, Anjo (JP)

(73) Assignee: Denso Corporation, Kariya (JP)

( * ) Notice: Subject to any disclaimer, the term of this patent is extended or adjusted under 35 U.S.C. 154(b) by 116 days.

(21) Appl. No.: 11/984,982

(22) Filed: Nov. 26, 2007

(65) Prior Publication Data

US 2008/0136568 A1 Jun. 12, 2008

(30) Foreign Application Priority Data

Dec. 6, 2006 (JP) ..... 2006-329663

(51) Int. Cl.
*H01H 67/02* (2006.01)

(52) U.S. Cl. ..... 335/126; 335/131

(58) Field of Classification Search ..... 335/126, 335/131

See application file for complete search history.

(56) References Cited

U.S. PATENT DOCUMENTS 4,990,874 A * 2/1991 Shiroyama ..... 335/126
5,023,466 A * 6/1991 Isozumi ..... 290/48
5,039,967 A * 8/1991 Morishita et al. ..... 335/131
5,227,751 A * 7/1993 Shiroyama et al. ..... 335/126
5,245,304 A * 9/1993 Zenmei ..... 335/126
5,252,935 A * 10/1993 Yamamoto et al. ..... 335/126
5,679,935 A * 10/1997 Baba et al. ..... 200/17 R
5,812,041 A * 9/1998 Ishikawa et al. ..... 335/126
5,901,604 A * 5/1999 Sato et al. ..... 74/7 A
6,269,706 B1 * 8/2001 Kuragaki et al. ..... 74/7 A
6,404,310 B1 * 6/2002 Ando et al. ..... 335/133

FOREIGN PATENT DOCUMENTS

JP B2-2763226 3/1998

* cited by examiner

*Primary Examiner*—Elvin G Enad
*Assistant Examiner*—Alexander Talpalatskiy
(74) *Attorney, Agent, or Firm*—Oliff & Berridge, PLC

(57) ABSTRACT

The electromagnetic switch for use in a starter includes a B-terminal bolt fixed to a mold cover thereof so as to protrude outside from the mold cover, a first bush fitted to the B-terminal bolt and detachably fixed to the mold cover, and a terminal electrically connected to the B-terminal bolt and led out in a direction perpendicular to a longitudinal direction of the B-terminal bolt. The B-terminal bolt is applied with a current from an external battery through the terminal. The first bush is positioned with respect to the mold cover in a circumferential direction of the B-terminal bolt. A lead-out angle of the terminal is selectable from among a plurality of predetermined angular positions, and the terminal is held in a second bush detachably fitted to an outer periphery of the first bush so as to be locked immovable with respect to the first bush.

7 Claims, 5 Drawing Sheets

ELECTROMAGNETIC SWITCH FOR USE IN STARTER

CROSS-REFERENCE TO RELATED APPLICATION

This application is related to Japanese Patent Application No. 2006-329663 filed on Dec. 6, 2006, the contents of which are hereby incorporated by reference.

BACKGROUND OF THE INVENTION

1. Field of the Invention

The present invention relates to an electromagnetic switch used for opening and closing a main contact of a motor circuit of a starter.

2. Description of Related Art

Japanese Patent No. 2763226 discloses an electromagnetic switch having a structure shown in FIG. 8. As show in this figure, this electromagnetic switch includes a B-terminal bolt 100 fixed to a not shown mold cover, and a terminal 110 connected to the B-terminal bolt 100. The terminal 110 is led out in the direction orthogonal to a longitudinal direction of the B-terminal bolt 100. The terminal 110, which is insert-molded in a resin-made bush 120, is positioned in a predetermined lead-out angle theta by causing a pair of projections 130 formed in the bush 120 to abut against a side surface of a projecting wall section 140 formed in the mold cover.

However, the above described magnetic switch has a problem in that it requires newly manufacturing the mold cover different from a common mold cover used for a common magnetic switch in which the terminal 110 is not used, and the B-terminal bolt 100 is directly connected with a battery cable, because the mold cover used for the above described magnetic switch has to be formed with the projecting wall section 140 to allow to use the terminal 110. Even if standardization were achieved for a such type of mold covers, the increase in mass and disadvantage in moldability would still remain.

Besides, when the lead-out angle theta is changed, the bush 120 has to be remanufactured, which causes the production cost to increase. In addition, since the terminal 110 is inserted into the bush 120 during manufacturing process of the bush 120, it is necessary to remove a thin-film burr produced in the boundary between the bush 120 and an exposed surface of the terminal 110.

SUMMARY OF THE INVENTION

The present invention provides an electromagnetic switch for use in a starter comprising:

a B-terminal bolt fixed to a mold cover of the electromagnetic switch so as to protrude outside from the mold cover;

a first bush fitted to the B-terminal bolt and detachably fixed to the mold cover, the B-terminal bolt protruding outside from the first bush; and a terminal electrically connected to the B-terminal bolt and led out in a direction perpendicular to a longitudinal direction of the B-terminal bolt, the B-terminal bolt being applied with a current from an external battery through the terminal;

wherein the first bush is positioned with respect to the mold cover in a circumferential direction of the B-terminal bolt, a lead-out angle of the terminal is selectable from among a plurality of predetermined angular positions, and the terminal is held in a second bush detachably fitted to an outer periphery of the first bush so as to be locked immovable with respect to the first bush.

The second bush may include a cylindrical wall section fitted to the outer periphery of the first bush so as to circularly surround a part of a periphery of the B-terminal bolt, the cylindrical wall section may be formed with an insertion hole, and the terminal may include a flat-plate section formed with a fitting hole into which the B-terminal bolt is inserted, the flat-plate section is inserted into an inside of the cylindrical wall section through the insertion hole.

A clearance may be provided between an inner periphery of the cylindrical wall section and the outer periphery of the first bush.

The cylindrical wall section may be formed with a plurality of projections projecting radially inwardly at the inner periphery thereof and arranged along a circumferential direction of the cylindrical wall section, the projections abutting against the outer periphery of the first bush to assure the clearance.

The first bush may be formed with a plurality of projections projecting radially outwardly at the outer periphery thereof and arranged along a circumferential direction of the first bush, the projections abutting against the inner periphery of the cylindrical wall section to assure the clearance.

The second bush may be provided with a protection cover closing an opening end of the cylindrical wall section, and a clearance may be provided between the protection cover and an end of the B-terminal bolt.

The mold cover may be formed with a fitting recess around the B-terminal bolt, an inner circumference of the fitting recess having a shape of a regular polygon, and the first bush may be formed with a fitting projection whose inner circumference has a shape complementary to the shape of the regular polygon, the fitting projection being fitted into the fitting recess to position the first bush with respect to the mold cover in the circumferential direction of the B-terminal bolt.

According to the present invention, it is possible to provide an electromagnetic switch for use in a starter in which a previously used common mold cover can be used as it is, and which can easily adapt to the change of a lead-out angle of its terminal.

Other advantages and features of the invention will become apparent from the following description including the drawings and claims.

PREFERRED EMBODIMENTS OF THE INVENTION

Figure 1B:
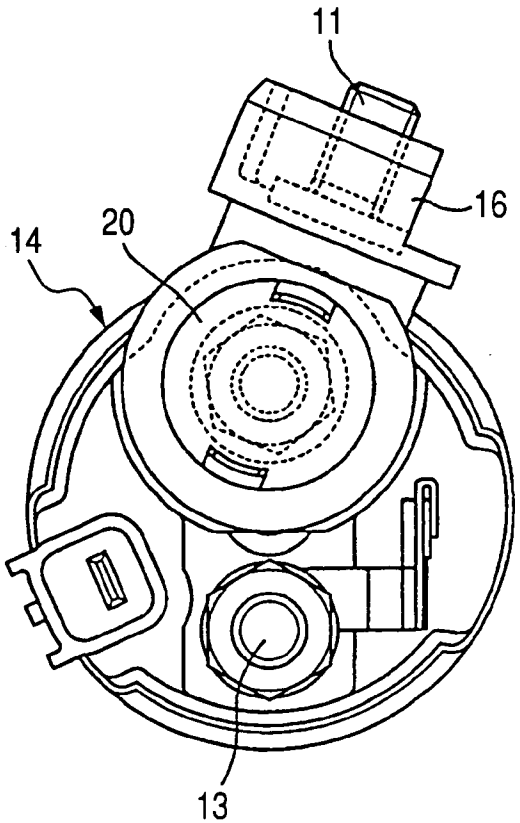
FIG. 1B is an axial front view of the electromagnetic switch as viewed from a mold cover thereof.
Figure 1A:
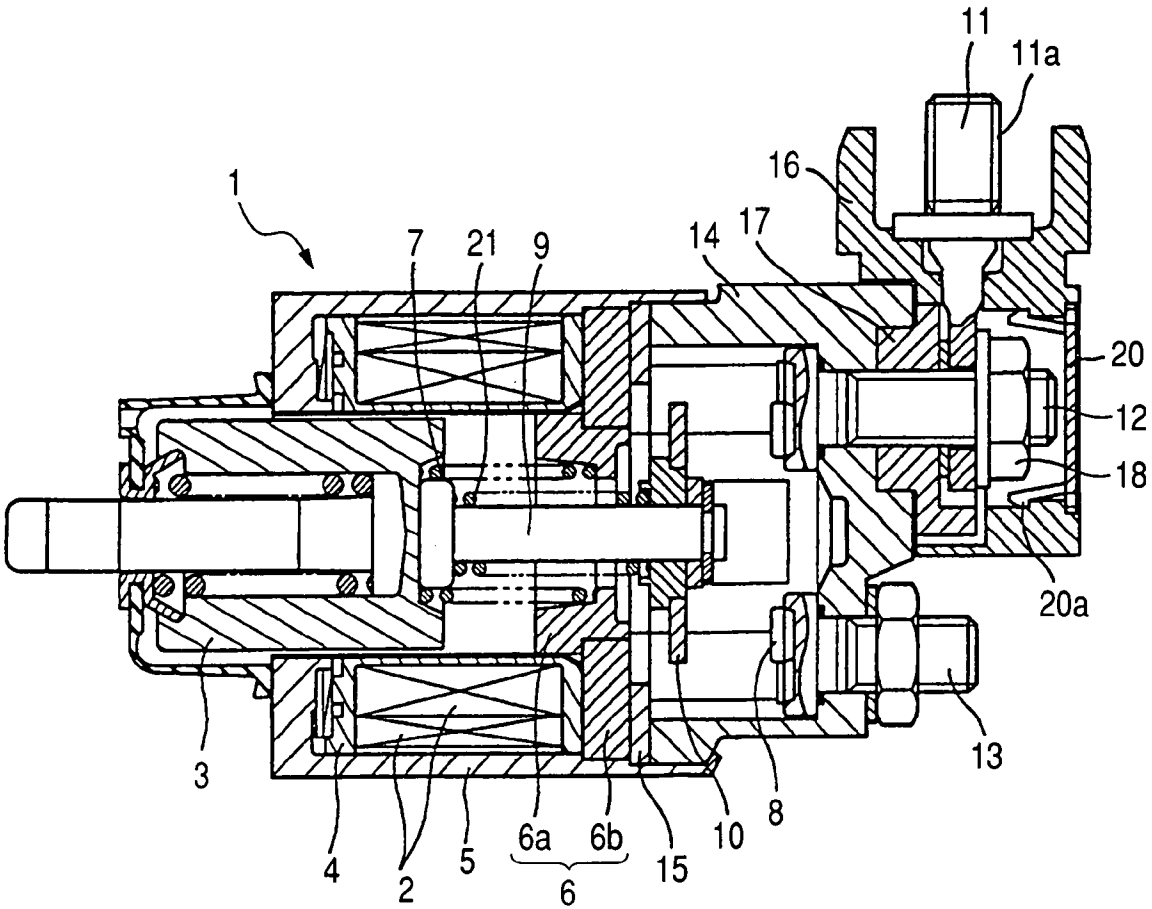
FIG. 1A is a cross-sectional view of an electromagnetic switch according to a first embodiment of the invention.

FIG. 1A is a cross-sectional view of an electromagnetic switch 1 according to an embodiment of the invention, and FIG. 1B is an axial front view of the electromagnetic switch 1 as viewed from the side of a mold cover 14 thereof. The electromagnetic switch 1 of this embodiment, which can be used in a starter (not shown) for starting a vehicle engine, includes an electromagnetic coil 2 producing a magnetic attraction force when applied with a current, a plunger 3 driven to move by the magnetic attraction force produced by the electromagnetic coil 2 in order to open and close a main contact (to be described later) connected to a motor circuit of the starter.

The electromagnetic coil 2 is wound around a bobbin 4 housed in a switch case 5 that constitutes a yoke. On the side of one end of the electromagnetic coil 2, there is disposed a fixed iron core 6 that is magnetized when the electromagnetic coil 2 is applied with a current. The fixed iron core 6, which is constituted by a base section 6*a* and a disk section 6*b*, forms a magnetic circuit around the electromagnetic coil 2 together with the switch case 5, and the plunger 3. The plunger 3 is disposed in the inner periphery of the electromagnetic coil 2 so as to axially oppose to the base section 6*a*, and pressed toward the opposite side of the base section 6*a* by a repulsive force of a return spring 7 located between the base section 6*a* and the plunger 3.

The main contact is constituted by a pair of fixed contacts 8 respectively connected to a corresponding one of two external terminals provided integral with the fixed contacts 8, and a movable contact 10 fixed to an end of a plunger shaft 9. The movable contact 10, which moves interlockingly with the plunger 3, makes and breaks electrical connection between the fixed contacts 8. One of the two external terminals is a B-terminal bolt 12 to which a battery current is supplied through a terminal 11 (to be explained later), and the other is an M-terminal bolt 13 to which a lead wire led out from a starter motor is connected. These terminals are fixed to a resin made mold cover 14. The mold cover 14 is crimped to an end of the switch case 5 with a rubber packing 15 being held between the disk section 6*b* of the fixed iron core 6 and the mold cover 14.

Next, explanation is made as to the structure around the terminal 11 connected to the B-terminal bolt. The terminal 11 has a male screw section 11*a* (see FIG. 1) connected with a not shown battery cable, and a flat plate section 11*c* formed with a fitting hole 11*b* into which the B-terminal bolt 12 is fitted. The terminal 11 is held by a resin-made insulating bush 16. As shown in FIG. 1, after a resin-made middle bush 17 (to be explained later) is fixed to the mold cover 14, the terminal 11 is assembled by fitting the B-terminal bolt 12 protruding from the middle bush 17 into the fitting hole of the flat plate section 11*c*, and fastening a nut 18 to the B-terminal bolt 12.

Figure 2:
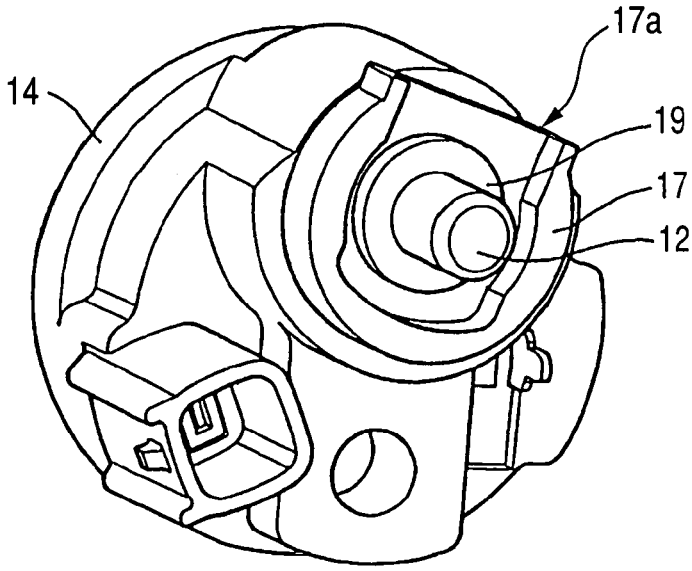
FIG. 2 is a perspective view of the mold cover of the electromagnetic switch.
Figure 5A:
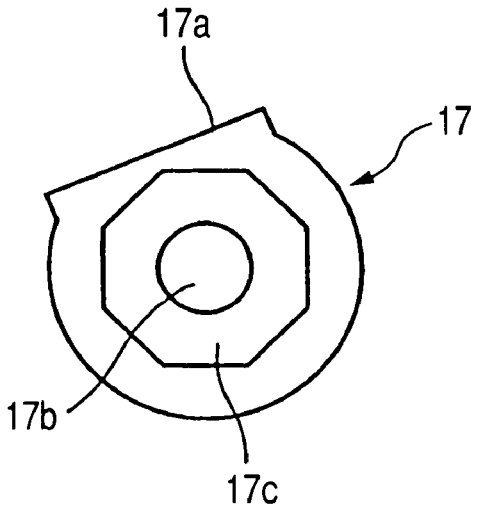
FIG. 5A is a plan view of a middle bush of the electromagnetic switch as viewed from the side of a fitting projection thereof.
Figure 5B:
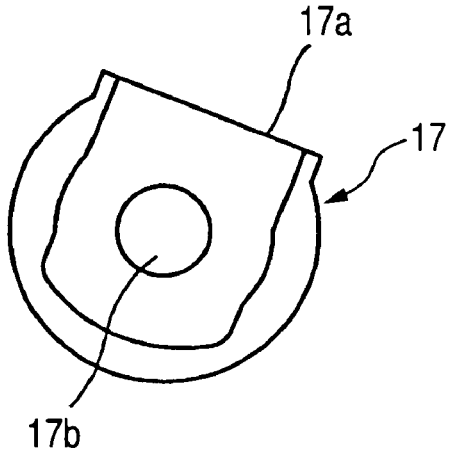
FIG. 5B is a plan view of the middle bush as viewed from the opposite side of the fitting projection.

As shown in FIG. 5, the middle bush 17 is made in roughly a circular shape formed with a flat surface section 17*a* at its circumference, and a circular hole 17*b* at its radially center portion. The middle bush 17 is detachably assembled to the mold cover 14 by inserting the B-terminal bolt 12 protruding from the mold cover 14 into the circular hole 17*b*. After that, as shown in FIG. 2, it is fixed to the mold cover 14 together with the B-terminal bolt 12 by use of a crimp washer 19 fitted to the B-terminal bolt 12.

Figure 4:
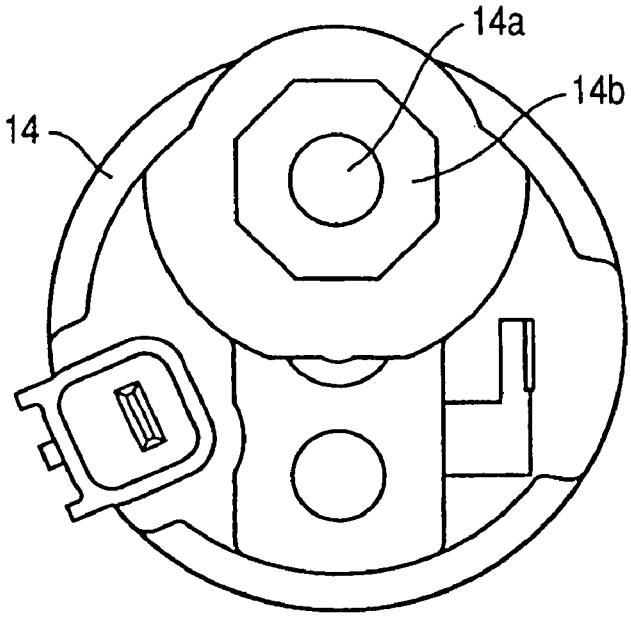
FIG. 4 is a plan view of the mold cover.

The middle bush 17 is positioned with respect to the mold cover 14 in the circumferential direction of the B-terminal bolt 12. And the position angle of the middle bush 17 can be selected from among a plurality of angular positions preset in the mold cover 14 as described below. As shown in FIG. 4, the mold cover 14 is formed with a circular hole 14*a* through which the B-terminal bolt 12 is led outside. And a fitting recess 14*b* whose inner circumference has a regular octagon is formed around the circular hole 14*a*. On the other hand, as shown in FIG. 5A, the middle bush 17 is formed with, around the circular hole 17*b*, a fitting projection 17*c* whose outer circumference has a regular octagon. By fitting the fitting projection 17*c* into the fitting recess 14*b*, the middle bush 17 is positioned with respect to the mold cover 14 in the circumferential direction of the B-terminal bolt 12. By changing the fitting angle of the fitting projection 17*c* into the fitting recess 14*b*, the angular position of the middle bush 17 can be changed at 45° intervals.

Figure 3:
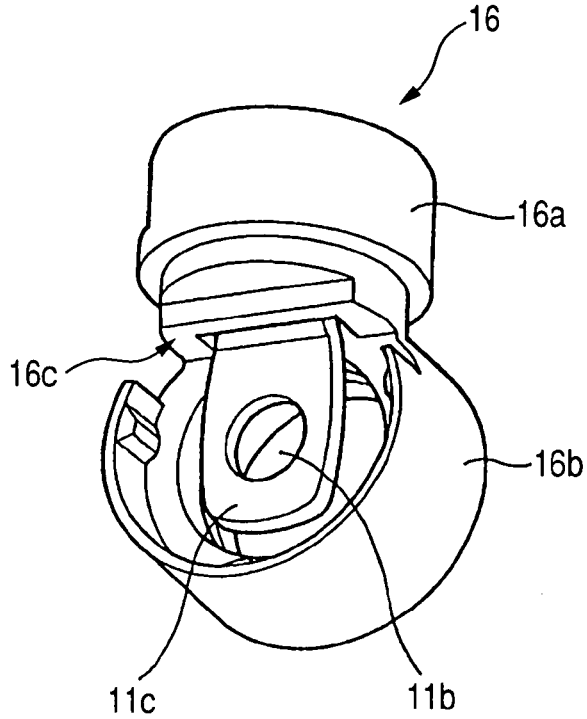
FIG. 3 is a perspective view of an insulating bush of the electromagnetic switch.

The insulating bush 16 is formed with a protecting wall section 16*a* for protecting the periphery of the male screw section 11*a* of the terminal 11, and a cylindrical wall section 16*b* detachably fitted to the outer circumference of the middle bush 17 and circularly surrounding the B-terminal bolt 12. Between the protecting wall section 16*a* and the cylindrical wall section 16*b*, there is formed a not shown insertion hole into which the flat plate section 11*c* is inserted. The terminal 11 is held in the insulating bush 16 in a state that the flat plate section 11*c* inserted into the insertion hole protrudes into the inside of the cylindrical wall section 16*b* (see FIG. 3). The cylindrical wall section 16*b* of the insulating bush 16 is formed with a flat surface 16*c* at an inner periphery thereof to which the insertion hole opens. Since the flat surface section 17*a* of the middle bush 17 and the flat surface section 16*c* of the cylindrical wall section 16*b* abut against each other when the cylindrical wall section 16*b* is fitted to the outer circumference of the middle bush 17, the insulating bush 16 can be locked immovable with respect to the middle bush 17.

Figure 6:
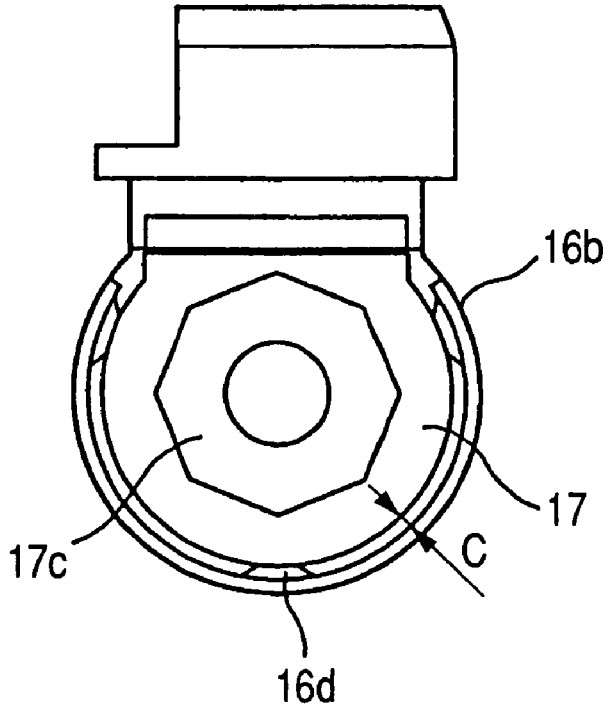
FIG. 6 is a plan view of the insulating bush and the middle bush fitted to each other.

As shown in FIG. 6, the cylindrical wall section 16*b* fitted to the outer periphery of the middle bush 17 is formed with a plurality of (three in this embodiment) projections 16*d* projecting radially inwardly at its inner periphery along the circumferential direction. Since these projections 16*d* abut against the outer periphery of the middle bush 17, a certain clearance C can be ensured between the inner periphery of the cylindrical wall section 16*b* and the outer periphery of the middle bush 17. As shown in FIG. 1, the insulating bush 16 is also provided with a protection cover 20 closing an opening end of the cylindrical wall section 16*b*. The protection cover 20 includes a pair of claw sections 20*a* radially opposed to each other. The claw sections 20*a* are locked and fixed to a step portion formed in the inner periphery of the cylindrical wall section 16*b* so that the protection cover 20 is fixed to the cylindrical wall section 16*b*. It should be noted that the protection cover 20 fixed to the cylindrical wall section 16*b* is not in contact with the B-terminal bolt 12, and a certain clearance is assured between the protection cover 20 and a front end of the B-terminal bolt 12.

Next, explanation is made as to the operation of the electromagnetic switch 1. When a not shown starter switch is turned on to pass a current to the electromagnetic coil 2, the fixed iron core 6 is magnetized and produces a magnetic attraction force, as a consequence of which the plunger 3 moves toward the base section 6*a* side (toward the right side in FIG. 1) while compressing the return spring 7. This movement of the plunger 3 pushes out the plunger shaft 9 to cause the movable contact 10 fixed to the end of the plunger shaft 9 to abut against the fixed contacts 8. Thereafter, the plunger 3 further moves while compressing a contact pressure spring 21 (see FIG. 1), until it abuts against the end surface of the base section 6*a*.

As a result, the compressed load of the contact pressure spring 21 is applied to the movable contact 10. In consequence, the movable contact 10 is pressed against the fixed contacts 8 to set the main contact in the closed sate so that the starter motor is applied with a current from the battery. After startup of the engine, when the starter switch is turned off to stop the current from flowing to the electromagnetic coil 2, and accordingly the magnetic attraction force disappears, since the plunger 3 is pushed back to the opposite side of the base section 6*a* by the repulsive force of the return spring 7, the movable contact 10 moves away from the fixed contacts 8 to thereby stop the supply of electric power to the starter motor.

The first embodiment described above offers the following advantages. In the electromagnetic switch 1 of this embodiment, the insulating bush 16 holding the terminal 11 is fitted to the outer periphery of the middle bush 17, and locked immovable with respect to the middle bush 17. The position angle of the middle bush 17 with respect to the mold cover 14 can be selected from among a plurality of preset angular positions. To be in more detail, by changing the fitting angle of the fitting projection 17*c* provided in the middle bush 17 into the fitting recess 14*b* formed in the mold cover 14, the orientation of the insulating bush 16 with respect to the middle bush 17 can be changed. In the embodiment, since the inner circumference of the fitting recess 14*b* and the outer circumference of the fitting projection 17*c* have a shape of a regular octagon. Accordingly, there is flexibility in the lead-out angle of the terminal 11.

Figure 7:
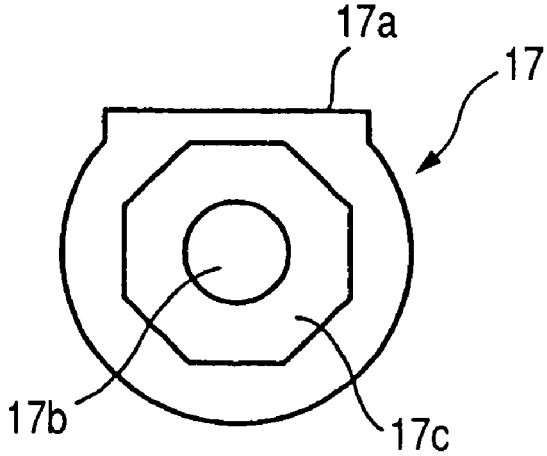
FIG. 7 is a plan view of an altered version of the middle bush.
Figure 8:
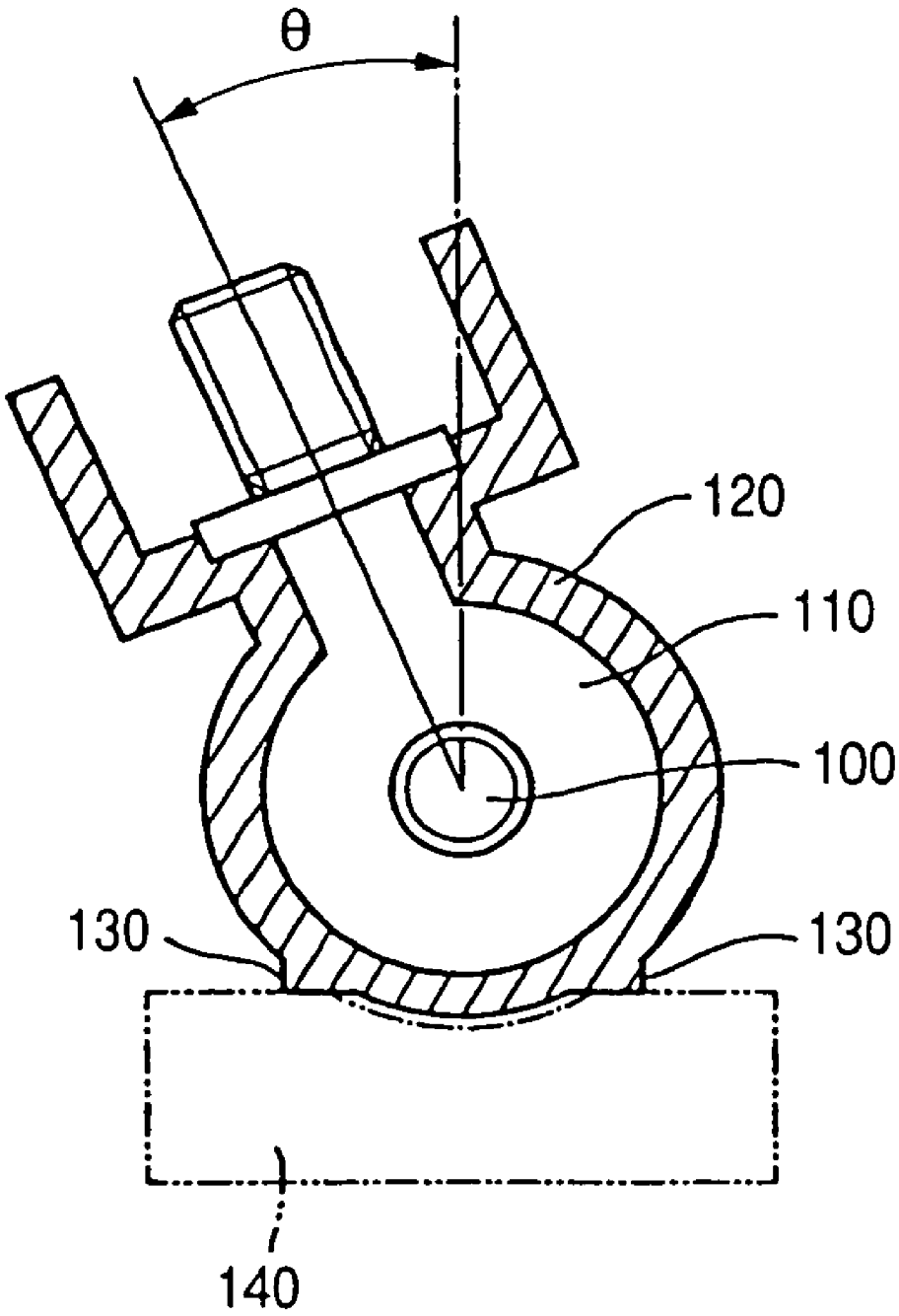
FIG. 8 PRIOR ART
FIG. 8 is a diagram showing a structure of a conventional electromagnetic switch.

Incidentally, in a case where it is not possible to adapt to the change of the lead-out angle of the terminal 11 by changing the position angle of the middle bush 17 with respect to the mold cover 14, that is, in a case where a desired lead-out angle cannot be obtained by selecting the position angle of the middle bush 17 from among the plurality of preset angular positions, the middle bush 17 may be altered in shape. FIG. 7 shows an example of an altered version of the middle bush 17 in which the angle of the fitting projection 17*c* with respect to the flat surface section 17*a* differs by 22.5° from that of the middle brush 17 used in the embodiment. In this a case, it is not necessary to newly manufacture the insulating bush 16, and it is only necessary to newly manufacture the middle bush 17 having the relatively simple shape. This makes it possible to reduce the production cost of the electromagnetic switch 1 and to improve the productivity of the electromagnetic switch 1.

According to the embodiment, since the middle bush 17 provided between the mold cover 14 and the insulating bush 16 is detachably assembled to the mold cover 14, it is not necessary to provide the mold cover 14 with any projecting detent wall section unlike the conventional electromagnetic switch disclosed in Japanese Patent No. 2763226. Accordingly, since it is possible to use a conventionally used mold cover as the mold cover 14, it is unnecessary to newly manufacture the mold cover 14. This makes it possible to prevent the number of parts of the electromagnetic switch 1 to increase.

The terminal 11 is held in the insulating bush 16 in a state that the flat plate section 11*c* inserted into the insertion hole formed in the insulating bush 16 protrudes to the inside of the cylindrical wall section 16*b*. Accordingly, since it is not necessary to insert-mold the terminal 11 in the insulating bush 16, the work for removing a thin-film burr produced during the insert-molding becomes unnecessary. In addition, since the insulating bush 16 can be resin-molded alone without inserting the terminal 11 therein, the production cost can be reduced and the productivity can be increased compared to the conventional case where the terminal 11 is insert-molded. The insulating bush 16 is provided with the protection cover 20 closing the opening end of the cylindrical wall section 16*b*, and a certain clearance is assured between the protection cover 20 and the front end of the B-terminal bolt 12. Since the protection cover 20 is not in contact with the B-terminal bolt 12, it is possible to prevent the protection cover 20 from undergoing thermal deformation due to the heat of the B-terminal bolt applied with a high voltage from the battery.

The insulating bush 16 is provided with a plurality of the projections 16*d* at the inner periphery of the cylindrical wall section 16*b* fitting to the outer periphery of the middle bush 17. Since the projections 16*d* abut against the outer periphery of the middle bush 17, there is assured a certain clearance C between the inner periphery of the cylindrical wall section 16*b* and the outer periphery of the middle bush 17. Accordingly, when the insulating bush 16 is flooded with water, and water enters the cylindrical wall section 16*b*, since the water drains through this clearance C, it can be prevented that water accumulates in the cylindrical wall section 16*b*. This improves the insulativity of the electromagnetic switch 1. Furthermore, the abutment of the projections 16*d* formed in the inner periphery of the cylindrical wall section 16*b* against the outer periphery of the middle bush 17 makes it possible to center the cylindrical wall section 16*b* in the radial direction with respect to the middle bush 17. This makes it possible to surely fit the B-terminal bolt 12 into the fitting hole 11*b* formed in the flat plate section 11*c* of the terminal 11.

Variants

In the embodiment, the projections 16*d* are formed in the inner periphery of the cylindrical wall section 16*b*, however, such projections may be formed in the outer periphery of the middle bush 17. Also in this case, abutment of these projections against the inner periphery of the cylindrical wall section 16*b* assures a certain clearance between the inner periphery of the cylindrical wall section 16*b* and the outer periphery of the middle bush 17. Although the inner circumference of the fitting recess 14*b* and the outer circumference of the fitting projection 17*c* have a shape of a regular octagon in the embodiment, they may have other shape, such as a regular hexagon, or a regular tetragon.

The above explained preferred embodiments are exemplary of the invention of the present application which is described solely by the claims appended below. It should be understood that modifications of the preferred embodiments may be made as would occur to one of skill in the art.

What is claimed is:

1. An electromagnetic switch for use in a starter comprising:

a B-terminal bolt fixed to a mold cover of said electromagnetic switch so as to protrude outside from said mold cover;

a first bush fitted to said B-terminal bolt and detachably fixed to said mold cover, said B-terminal bolt protruding outside from said first bush; and a terminal electrically connected to said B-terminal bolt and led out in a direction perpendicular to a longitudinal direction of said B-terminal bolt, said B-terminal bolt being applied with a current from an external battery through said terminal;

wherein said first bush is positioned with respect to said mold cover in a circumferential direction of said B-terminal bolt, a lead-out angle of said terminal is selectable from among a plurality of predetermined angular positions, and said terminal is held in a second bush detachably fitted to an outer periphery of said first bush so as to be locked immovable with respect to said first bush, and said mold cover is formed with a fitting recess around said B-terminal bolt, an inner circumference of said fitting recess having a shape of a regular polygon, and said first bush is formed with a fitting projection whose inner circumference has a shape complementary to said shape of said regular polygon, said fitting projection being fitted into said fitting recess to position said first bush with respect to said mold cover in said circumferential direction of said B-terminal bolt.

2. The electromagnetic switch according to claim 1, wherein said second bush includes a cylindrical wall section fitted to said outer periphery of said first bush so as to circularly surround a part of a periphery of said B-terminal bolt, said cylindrical wall section is formed with an insertion hole, and said terminal includes a flat-plate section formed with a fitting hole into which said B-terminal bolt is inserted, said flat-plate section being inserted into an inside of said cylindrical wall section through said insertion hole.

3. The electromagnetic switch according to claim 2, wherein a clearance is provided between an inner periphery of said cylindrical wall section and said outer periphery of said first bush.

4. The electromagnetic switch according to claim 3, wherein said cylindrical wall section is formed with a plurality of projections projecting radially inwardly at said inner periphery thereof and arranged along a circumferential direction of said cylindrical wall section, said projections abutting against said outer periphery of said first bush to assure said clearance.

5. The electromagnetic switch according to claim 3, wherein said first bush is formed with a plurality of projections projecting radially outwardly at said outer periphery thereof and arranged along a circumferential direction of said first bush, said projections abutting against said inner periphery of said cylindrical wall section to assure said clearance.

6. The electromagnetic switch according to claim 2, wherein said second bush is provided with a protection cover closing an opening end of said cylindrical wall section, and a clearance is provided between said protection cover and an end of said B-terminal bolt.

7. An electromagnetic switch for use in a starter comprising:

a B-terminal bolt to be applied with a current from an external battery;

an M-terminal bolt connected to a motor circuit of said starter;

a main contact operated to make or break electrical connection between said B-terminal bolt and said M-terminal bolt;

a mold cover which houses said main contact and to which said B-terminal bolt and said M-terminal bolt are fixed so as to protrude therefrom;

an electromagnetic coil producing a magnetic attraction force when applied with a current;

a plunger driven to move by said magnetic attraction force to operate said main contact to make said electrical connection;

a first bush fitted to said B-terminal bolt and detachably fixed to said mold cover; and a terminal electrically connected to said B-terminal bolt and led out in a direction perpendicular to a longitudinal direction of said B-terminal bolt to be connected to said external battery;

wherein said first bush is positioned with respect to said mold cover in a circumferential direction of said B-terminal bolt, a lead-out angle of said terminal is selectable from among a plurality of predetermined angular positions, and said terminal is held in a second bush detachably fitted to an outer periphery of said first bush so as to be locked immovable with respect to said first bush, and said mold cover is formed with a fitting recess around said B-terminal bolt, an inner circumference of said fitting recess having a shape of a regular polygon, and said first bush is formed with a fitting projection whose inner circumference has a shape complementary to said shape of said regular polygon, said fitting projection being fitted into said fitting recess to position said first bush with respect to said mold cover in said circumferential direction of said B-terminal bolt.

* * * * *